US006195855B1

(12) United States Patent
Feyerl

(10) Patent No.: US 6,195,855 B1
(45) Date of Patent: Mar. 6, 2001

(54) APPARATUS FOR CHANGING THE NEEDLE BOARDS OF A NEEDLING MACHINE

(75) Inventor: Gunther Feyerl, Linz (AT)

(73) Assignee: Textilmaschinenfabrik Dr. Ernst Fehrer Aktiengesellschaft, Leonding (AT)

( * ) Notice: Subject to any disclaimer, the term of this patent is extended or adjusted under 35 U.S.C. 154(b) by 0 days.

(21) Appl. No.: 09/570,710

(22) Filed: May 15, 2000

(30) Foreign Application Priority Data

May 31, 1999 (AT) ..... A 966/99

(51) Int. Cl.[7] ..... D04H 18/00
(52) U.S. Cl. ..... 28/115; 28/107
(58) Field of Search ..... 28/107, 109, 110, 28/111, 114, 115, 113; 414/331, 788, 788.1, 788.4, 790.1, 790.4, 288

(56) References Cited

U.S. PATENT DOCUMENTS 4,884,324 * 12/1989 Stanislaw ..... 28/107
5,287,604 * 2/1994 Feyerl ..... 28/115
6,003,215 * 12/1999 St. Jacques ..... 28/115

FOREIGN PATENT DOCUMENTS 395 323 4/1992 (AT) .

* cited by examiner

*Primary Examiner*—Amy B. Vanatta
(74) *Attorney, Agent, or Firm*—Collard & Roe, P.C.

(57) ABSTRACT

There is described an apparatus for changing the needle boards (3) of a needling machine, comprising a mounting guide (4) for the needle boards (3) to be coupled to each other in a tension-proof way on both sides of the needle bars disposed one behind the other in direction of the working width of the needling machine, to which needle bars the needle boards (3) are replaceably fixed, comprising a feeding guide (2) for the needle boards (3) in extension of the mounting guide (4) on one side of the needling machine, and comprising a step conveyor (5) associated to the feeding guide (2), which step conveyor has engageable and disengageable carriers for the needle boards (3). To create advantageous constructional conditions it is proposed that the carriers of the step conveyor (5) constitute centering pins (9) which engage in centering bushes (10) of the needle boards (3).

4 Claims, 4 Drawing Sheets

APPARATUS FOR CHANGING THE NEEDLE BOARDS OF A NEEDLING MACHINE

FIELD OF THE INVENTION

This invention relates to an apparatus for changing the needle boards of a needling machine, comprising a mounting guide for the needle boards to be coupled to each other in a tension-proof way on both sides of the needle bars disposed one behind the other in direction of the working width of the needling machine, to which needle bars the needle boards are replaceably fixed, comprising a feeding guide for the needle boards in extension of the mounting guide on one side of the needling machine, and comprising a step conveyor associated to the feeding guide, which step conveyor has engageable and disengageable carriers for the needle boards.

DESCRIPTION OF THE PRIOR ART

To be able to easily perform the replacement of the needle boards of a needling machine, it is known (AT 395 323 B) to arrange the needle boards one above the other in a vertically adjustable magazine and to provide a feeding guide for the needle boards between this magazine and the mounting guide, so that the needle boards can be inserted from the magazine via the feeding guide into the mounting guide of the needling machine. For moving the needle boards there is provided a step conveyor associated to the feeding guide, which step conveyor has carriers which are adjustable along the conveying step via a toothed belt and which consist of swivelling levers engaging in a needle board in the vicinity of the feeding guide. Since the needle boards can be coupled to each other in a tension-proof way, the needle boards can be inserted in the needling machine one after the other along the mounting guide on both sides of the needle bars and can then be connected with the needle bars via corresponding clamping means. A major disadvantage of these known apparatuses for changing the needle boards is the fact that complex feeding and mounting guides must be provided for the needle boards, in order to ensure the required precise board alignment within the machine, which involves a comparatively high constructional effort.

SUMMARY OF THE INVENTION

It is therefore the object underlying the invention to provide an apparatus as described above such that simple mounting and feeding guides will be sufficient without having to do without a precise positioning of the needle boards in a needling machine.

This object is solved by the invention in that the carriers of the step conveyor constitute centering pins which engage in centering bushes of the needle boards.

Since the carriers of the step conveyor serve as centering pins, the needle board being coupled to the step conveyor in the vicinity of the feeding guide is necessarily aligned with respect to the step conveyor due to the engagement of the carriers, which step conveyor can ensure with comparatively simple means a precise enough guidance of the carrier head provided with the centering pins, so as to align the individual needle boards and insert the same in the aligned position along the mounting guide into the needling machine. By means of the alignment of the respective needle board inserted into the feeding guide, the positive coupling of the needle boards disposed one behind the other necessarily leads to an alignment of the needle boards positively connected with this needle board and already inserted into the mounting guide, so that the guiding accuracy of the mounting guide and the feeding guide is not relevant for the alignment of the needle boards.

To be able to provide the apparatus for changing the needle boards with a comparatively short design, the needle boards may have two sets of centering bushes at a mutual distance corresponding to half the board length measured in direction of the working width of the needling machine, so that the step conveyor must be designed for a conveying step corresponding to half the board length. To move a needle board corresponding to its full length, two conveying steps of the step conveyor are therefore necessary, which in this case must necessarily be performed before another needle board can be coupled to the step conveyor.

Although the centering pins can each be actuated separately, particularly simple constructional conditions are obtained when the centering pins are disposed on a common support adjustable vertical to the guiding plane of the feeding guide. The centering pins can thus be adjusted together, which not only permits a simplification of the construction, but also involves certain advantages as regards the alignment accuracy.

To prevent that needle boards which undergo an inadequate alignment are inserted into the mounting guide of the needling machine, the step conveyor may be actuatable in dependence on the depth of penetration of the centering pins into the centering bushes of the needle boards. Since the centering pins have a conical leading end to support their alignment task, the alignment of the needle board may be insufficient when the centering pins only partly engage in the centering bushes of the needle boards. For this reason, the depth of penetration of the centering pins into the centering bushes is monitored, so that the actuation of the step conveyor is blocked in the case of an only partial engagement of the centering pins.

BRIEF DESCRIPTION OF THE DRAWING

In the drawing, the subject-matter of the invention is represented by way of example, wherein.

DESCRIPTION OF THE PREFERRED EMBODIMENT

Figure 1:
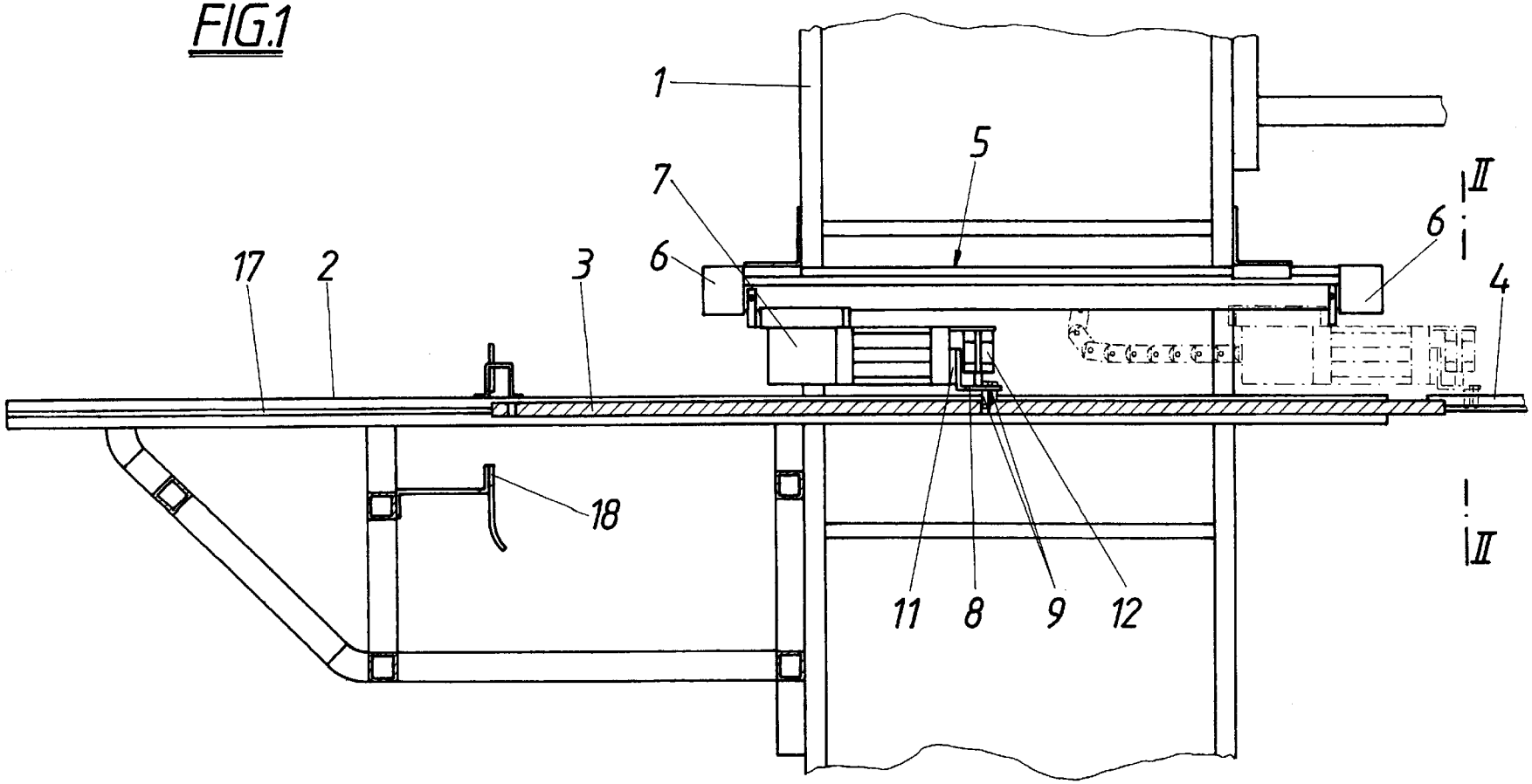
FIG. 1 shows an inventive apparatus for changing the needle boards of a needling machine in a schematic longitudinal section.
Figure 3:
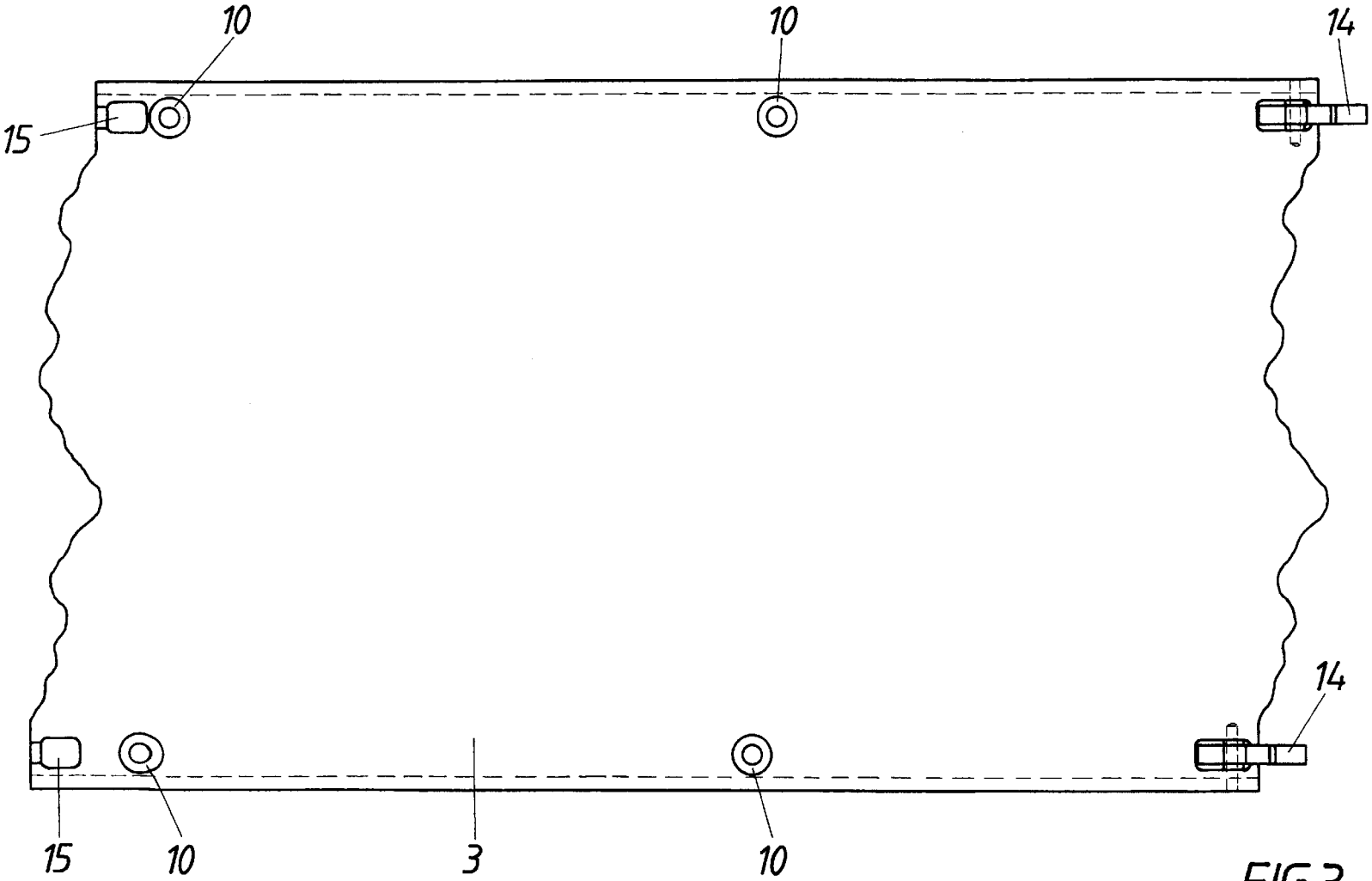
FIG. 3 shows a top view of a needle board with inventive centering bushes on an enlarged scale.
Figure 4:
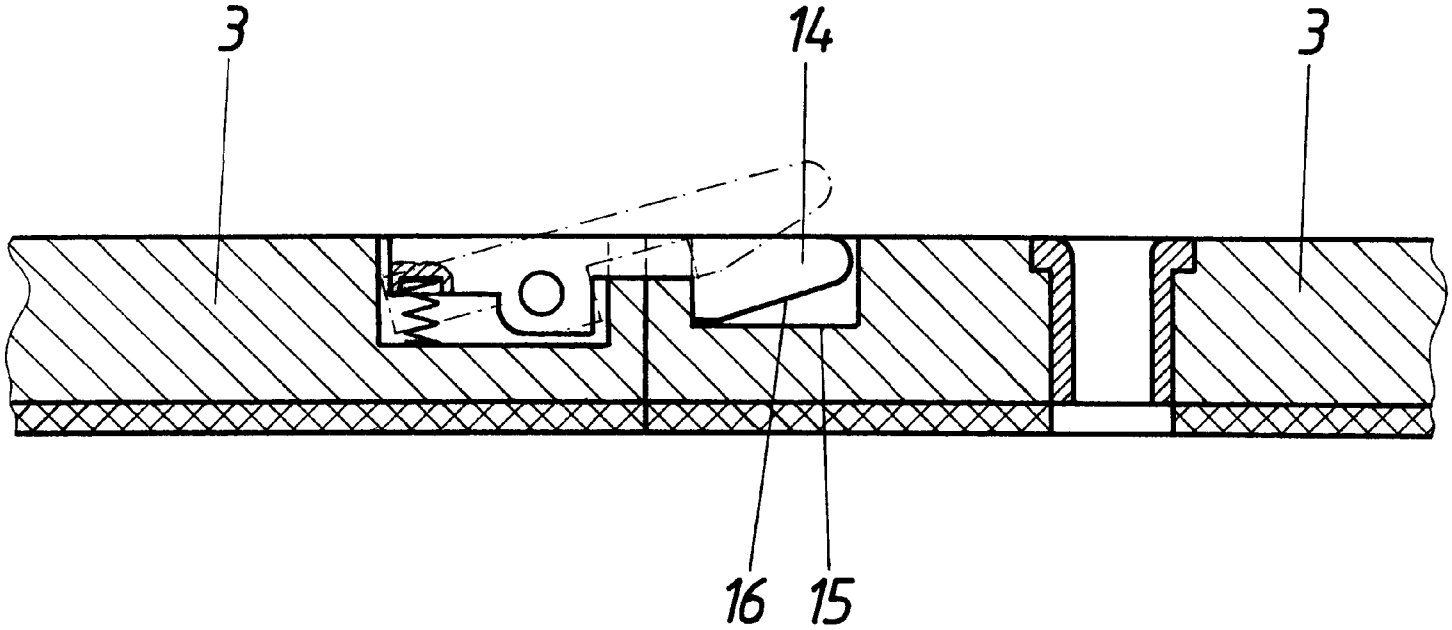
FIG. 4 shows a section along line IV—IV of FIG. 3 on an enlarged scale.

In accordance with the illustrated embodiment, the apparatus for changing the needle boards of a needling machine has a feeding guide 2 for the needle boards 3 to be replaced, which feeding guide can be connected to the post 1 of the needling machine, namely in extension of a mounting guide 4 which extends on both sides of the needle bars of the needling machine above the stripper. When they are positioned within the needling machine, the needle boards 3 inserted in the mounting guide 4 can be clamped to the needle bars in a conventional way. To be able to insert the needle boards 3 from the feeding guide 2 into the mounting guide 4 in an aligned condition, a step conveyor 5 is provided, which is associated to the feeding guide 2 and comprises a carrier head 7 movable between stops 6, which carrier head is indicated in FIG. 1 in the two end positions. This carrier head 7 has a support 8 for centering pins 9 extending transverse to the feeding guide 2, which centering pins cooperate with centering bushes 10 in the needle boards 3. Via slideways 11, the support 8 is adjustably mounted on the carrier head 7 vertical to the guiding plane of the feeding guide 2 and can be moved between a locking position and an unlocking position by means of a lifting cylinder 12. In the locking position, the centering pins 9 engage in the centering bushes 10 of the needle boards 3, where the needle board 3 thereby coupled to the step conveyor 5 is necessarily aligned. Upon actuating the actuating cylinder 13 for the carrier head 7, the needle board 3 is moved by the carrier head 7 along the feeding guide 2 by one conveying step towards the mounting guide 4. In accordance with the embodiment, the needle boards 3 are equipped with two sets of centering bushes 10, whose mutual distance corresponds to half the board length in direction of the feeding guide 2, as can in particular be taken from FIG. 3. Therefore, the conveying step length of the step conveyor 5 need merely correspond to half the board length in direction of the working width of the needling machine, which provides for a comparatively small projection width of the apparatus To ensure that the needle boards can not only be inserted in the mounting guide 4 via the step conveyor 5, but can also be withdrawn from the mounting guide 4 into the feeding guide 2, the needle boards disposed one behind the other must be connected with each other in a tension-proof way. For this purpose, the needle boards 3 have spring-loaded coupling hooks 14 on one end face and, on the opposite end face, locking recesses 15 for the coupling hooks 14 of the respective needle board 3 to be connected, as is shown in FIG. 4. Since the pivotally mounted coupling hooks 14 and the inclined stop face 16 provided in the vicinity of the hooks are spring-loaded, the needle boards 3 need merely be moved with respect to each other, in order to effect an automatic engagement of the coupling hooks 14 into the locking recesses 15. To release such coupling, the coupling hooks 14 must, however, be lifted from the locking recesses 15 against the spring force.

Figure 2:
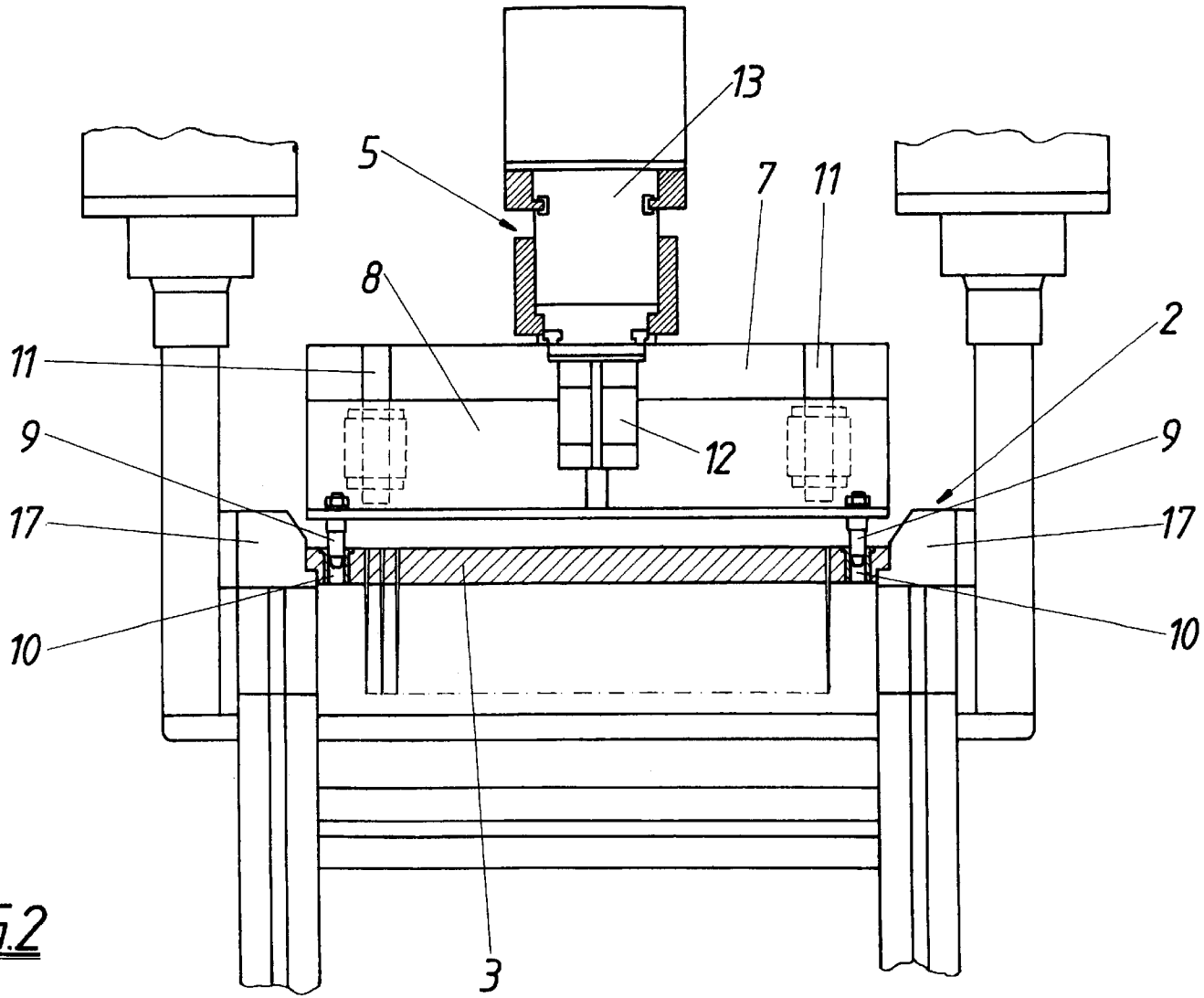
FIG. 2 shows this apparatus in a simplified section along line II—II of FIG. 1 on an enlarged scale.

To incorporate the needle boards in the needling machine, the first needle board 3 is first of all inserted in the feeding guide 2, which in accordance with FIG. 2 forms supporting strips 17 for the needle boards 3. To obtain a prepositioning of the needle boards 3, which permits a safe engagement of the centering pins 9 into the centering bushes 10, stops protruding into the guideway of the feeding guide 2 may be provided, which upon centering the first needle board 3 must be retracted from the guideway. The proper insertion of the needle boards 3 into the feeding guide 2 may also be monitored via a photoelectric barrier 18. Upon engagement of the centering pins 9 into the centering bushes 10 of the needle board 3, the needle board is advanced by half a needle board length towards the mounting guide 4 by actuating the actuating cylinder 13, so as to be able to insert the next needle board 3 into the feeding guide 2 and positively connect the same with the preceding needle board via the coupling hooks 14. After another conveying step of the step conveyor 5, the newly attached needle board 3 can be coupled to the step conveyor 5 as described above by aligning it at the same time, where the process is repeated for each further needle board 3 until the needle boards positively connected to form a strand have completely been inserted in the needling machine, in order to be connected with the associated needle bars by clamping.

To replace the needle boards 3 connected with the needle bars, the needle boards must be detached from the needle bars and be withdrawn from the mounting guide 4 in the inverse order by means of the step conveyor 5, in order to be removed one after the other from the feeding guide 2.

What is claimed is:

1. An apparatus for changing needle boards of a needling machine, comprising a mounting guide for the needle boards to be coupled to each other in a tension-proof way on both sides of needle bars disposed one behind the other in direction of the working width of the needling machine, to which needle bars the needle boards are replaceably fixed, comprising a feeding guide for the needle boards in extension of the mounting guide on one side of the needling machine, and comprising a step conveyor associated to the feeding guide, which step conveyor has engageable and disengageable carriers for the needle boards, characterized in that the carriers of the step conveyor constitute centering pins which engage in centering bushes of the needle boards.

2. The apparatus as claimed in claim 1, characterized in that the needle boards have two sets of centering bushes at a mutual distance corresponding to half the board length measured in direction of the working width of the needling machine, and that the step conveyor is designed for a conveying step corresponding to half the board length.

3. The apparatus as claimed in claim 1, characterized in that the centering pins are disposed on a common support adjustable vertical to the guiding plane of the feeding guide.

4. The apparatus as claimed in claim 1, characterized in that the step conveyor can be actuated in dependence on the depth of penetration of the centering pins into the centering bushes of the needle boards.

* * * * *